US012152829B2

(12) United States Patent
Yoo et al.

(10) Patent No.: US 12,152,829 B2
(45) Date of Patent: Nov. 26, 2024

(54) REFRIGERATOR

(71) Applicant: LG ELECTRONICS INC., Seoul (KR)

(72) Inventors: Daehyun Yoo, Seoul (KR); Geonwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 289 days.

(21) Appl. No.: 17/791,021

(22) PCT Filed: Jan. 7, 2020

(86) PCT No.: PCT/KR2020/000296
§ 371 (c)(1),
(2) Date: Jul. 6, 2022

(87) PCT Pub. No.: WO2021/141156
PCT Pub. Date: Jul. 15, 2021

(65) Prior Publication Data

US 2023/0036523 A1 Feb. 2, 2023

(51) Int. Cl.
*F25D 23/06* (2006.01)
*F25D 23/02* (2006.01)

(52) U.S. Cl.
CPC ..... *F25D 23/067* (2013.01); *F25D 23/02* (2013.01); *F25D 23/062* (2013.01); *F25D 23/065* (2013.01); *F25D 2201/126* (2013.01); *F25D 2400/18* (2013.01)

(58) Field of Classification Search
CPC ..... F25D 23/06; F25D 23/062; F25D 23/063; F25D 23/065; F25D 23/067; F25D 2323/06
See application file for complete search history.

(56) References Cited

U.S. PATENT DOCUMENTS 2,416,845 A * 3/1947 Richard ..... F25D 23/063 403/376
2,753,695 A * 7/1956 Maranto ..... F25D 19/00 62/DIG. 13

(Continued)

FOREIGN PATENT DOCUMENTS

DE 102009032473 A1 * 1/2011 ..... F25D 23/065
DE 202017001207 U1 * 5/2017

(Continued)

OTHER PUBLICATIONS

International Search Report (with English Translation) dated Sep. 25, 2020 issued in Application No. PCT/KR2020/000296.

*Primary Examiner* — Andrew Roersma
(74) *Attorney, Agent, or Firm* — KED & Associates LLP

(57) ABSTRACT

A refrigerator according to this embodiment includes: an inner case configured to define a storage space; a middle plate disposed outside the inner case and configured to define a foaming space in which an insulating material is disposed together with the inner case; a cabinet cover disposed above the middle plate to define an outer appearance of a top surface, the cabinet cover being capable of being coupled to the middle plate by a coupling member; and a partition member configured to provide a moving path of the coupling member in the foaming space.

14 Claims, 10 Drawing Sheets

(56) References Cited

U.S. PATENT DOCUMENTS

| | | | | | |
|---|---|---|---|---|---|
| 3,999,820 | A * | 12/1976 | Haag | F25D 23/062 | 62/DIG. 13 |
| 4,050,145 | A * | 9/1977 | Benford | F25D 23/062 | 29/460 |
| 4,190,305 | A * | 2/1980 | Knight | E04H 5/10 | 52/309.7 |
| 4,752,171 | A * | 6/1988 | Pliml, Jr. | B29C 65/069 | 411/181 |
| 7,766,436 | B1 * | 8/2010 | Steinkuhl | F25D 23/02 | 312/204 |
| 8,813,458 | B2 * | 8/2014 | Geng | F16B 5/126 | 52/312 |
| 9,010,890 | B2 * | 4/2015 | Eckartsberg | A47B 57/425 | 312/408 |
| 11,428,458 | B2 * | 8/2022 | Park | F25D 23/10 | |
| 2005/0218764 | A1 | 10/2005 | Hong et al. | | |
| 2007/0099502 | A1 * | 5/2007 | Ferinauer | F25D 23/066 | 439/589 |
| 2011/0031861 | A1 * | 2/2011 | Gentry | F25J 3/04945 | 29/890.035 |
| 2014/0162014 | A1 * | 6/2014 | Rochefort | E04B 1/803 | 428/69 |
| 2019/0280511 | A1 | 9/2019 | Park et al. | | |

FOREIGN PATENT DOCUMENTS

| | | | | |
|---|---|---|---|---|
| JP | 2005-283090 | | 10/2005 | |
| KR | 20-1999-0035895 | | 9/1999 | |
| KR | 10-2004-0003319 | | 1/2004 | |
| KR | 10-2018-0106835 | | 10/2018 | |
| KR | 20180106835 | A * | 10/2018 | F25D 23/028 |
| KR | 10-2019-0106494 | | 9/2019 | |

* cited by examiner

REFRIGERATOR

CROSS-REFERENCE TO RELATED PATENT APPLICATIONS

This application is a U.S. National Stage Application under 35 U.S.C. § 371 of PCT Application No. PCT/KR2020/000296, filed Jan. 7, 2020, whose entire disclosures are hereby incorporated by reference.

TECHNICAL FIELD

The present invention relates to a refrigerator.

BACKGROUND ART

Generally, refrigerators are household appliances that are capable of store objects such as foods at a low temperature in a storage space provided in a cabinet. Since the storage space is surrounded by heat insulation wall, the inside of the storage space may be maintained at a temperature less than an external temperature.

The storage space may be classified into a refrigerating compartment or a freezing compartment according to a temperature range of the storage space. The food may be stored in the refrigerating compartment or the freezing compartment according to the type or condition of the food.

The refrigerator may be provided as a built-in type together with other electronic devices in the kitchen. In this case, a design in outer appearance of the refrigerator is performed in harmony with the furniture in the kitchen.

In addition, in recent years, installation positions of the refrigerator have been diversified, such as placing the refrigerator in the living room or the room instead of the kitchen according to various needs of the user.

As the installation positions of the refrigerator are diversified, the design of the outer appearance of the refrigerator is performed so that the outer appearance of the refrigerator is harmonized with the furniture in a space in which the refrigerator is installed.

For example, the outer appearance of the refrigerator may be designed to be made of wood to be harmonized with the furniture made of wood.

A refrigerator, in which a furniture door and a refrigerator door, which are made of wood, are screw-coupled to each other, is disclosed in Korean Patent Publication No. 10-2004-0003319, which is a prior art document.

However, the outer appearance made of the wood material may be damaged by moisture or the like when used for a long period of time and may require service such as replacement.

However, in the case of the prior art document, if it is required to perform a service such as the replacement or repair of the damaged furniture door, all the coupled screws have to be released, and thus, there is a problem in which a time taken for the service is long.

In addition, when an exterior of the furniture surrounding a main body of the refrigerator is damaged instead of the furniture door, in order to replace the exterior of the damaged furniture, there is a problem in that even the exterior, which is not damaged, has to be separated.

In addition, since the process of replacing the exterior of the damaged furniture is complicated and takes a long time, there is a problem in that user satisfaction with the service is reduced.

DISCLOSURE OF THE INVENTION

Technical Problem

An object of the present invention is to provide a refrigerator in which a cabinet cover made of a wood material is easily disassembled.

In addition, an object of the present invention is to provide a refrigerator in which a cabinet cover is easily separated without disassembling a rear panel disposed at a rear side from a cabinet.

In addition, an object of the present invention is to provide a refrigerator in which forward and backward movement of a cabinet cover is easily restricted in a mounted state of the cabinet cover in spite of a structure in which the cabinet cover is easily disassembled.

In addition, an object of the present invention is to provide a refrigerator capable of preventing deterioration of an insulation function of the refrigerator when the cabinet cover is disassembled and reassembled.

Technical Solution

A refrigerator according to the present invention for solving the above problems includes: an inner case configured to define a storage space; a middle plate disposed outside the inner case and configured to define a foaming space in which an insulating material is disposed together with the inner case; a cabinet cover disposed above the middle plate to define an outer appearance of a top surface, the cabinet cover being capable of being coupled to the middle plate by a coupling member; and a partition member configured to provide a moving path of the coupling member in the foaming space. Thus, an unintentional detachment of the cabinet cover may be prevented by the coupling member, and the cabinet cover may be easily detached when the coupling member does not restrict the movement of the cabinet cover.

A coupling hole through which the coupling member passes may be defined in the middle plate, an entrance hole through which the coupling member is accessible may be defined in the inner case, and the moving path may be aligned with the coupling hole and the entrance hole.

The partition member may include a partition body configured to divide the foaming space into a first region and a second region, wherein an internal space of the partition body may be the first region, an external space of the partition body may be the second region, and the first region may be configured to provide the moving path.

At least a portion of a top surface of the partition body may be spaced apart from the middle plate to provide a communication space of each of the first region and the second region.

The partition member may further include a cover configured to cover the entrance hole and the first region.

The cover may be coupled to the inner case in the internal region of the inner case to cover the entrance hole.

A coupling groove to which the coupling member is coupled may be defined in the cabinet cover, the coupling groove may be aligned with the moving path and the coupling hole, and the coupling member may be coupled to the middle plate and the cabinet cover.

The cover may include a sealing portion which is inserted into the entrance hole to shield the moving path and has a ring shape.

The cover may include a hook portion that is selectively mounted on the inner case.

The hook portion may be provided in plurality, and each of the plurality of hook portions may be spaced outward from an outer surface of the partition body.

A hook hole through which the hook portion passes to be mounted may be defined to pass through the inner case, and the hook portion may be seated between the hook hole and the outer surface of the partition body on a top surface of the inner case after passing through the hook hole.

The partition body may be integrated with the cover.

The partition body may be coupled to the inner case or integrated with the inner case.

The refrigerator may further include: a door disposed in front of the inner case to open and close the storage space; and a rear panel configured to cover a rear surface of the middle plate and define an outer appearance of the rear surface, wherein the fixing unit may be disposed closer to the door than the rear panel.

The cabinet cover may include a cover fixing portion that is selectively mounted on the middle plate, a cover fixing hole to which the cover fixing portion is fixed may be defined in the middle plate, the cover fixing portion may include a first portion provided on a bottom surface of the cabinet cover and a second portion having a diameter greater than that of the first portion, the cover fixing hole may include a first hole having a size into which the second portion is insertable and a second hole extending from the first hole and having a size less than that of the first hole, and the first hole may be disposed in front of the second hole.

Advantageous Effects

According to the proposed invention, the cabinet cover made of wood may be easily separated to save the time required for replacing the cabinet cover.

In addition, since it takes the short time to separate the cabinet cover, there may be the effect of improving the service efficiency.

In detail, since the cabinet cover is separated without disassembling the rear panel from the cabinet, the assembly process after the service may be simplified.

In addition, according to the present invention, since the coupling member for fixing the cabinet cover is provided, there may be the effect that the forward and backward movement of the cabinet cover is prevented.

In addition, according to the present invention, when the coupling member is disposed in the foaming space defined by the inner case and the middle plate, the partition member that provides the movement path of the coupling member may be provided, and thus, even after the foaming liquid is injected into the foaming space, the coupling member may be released and re-coupled.

In addition, since the foaming space is divided into the first region and the second region by the partition member, the insulating material disposed in the first region may be easily removed, and the coupling member may be easily released.

In addition, since the partition member includes the partition body forming the first region and the cover for shielding the first region of the partition body, there may be the effect in that the refrigerator is prevented from being deteriorated in insulation performance.

In addition, the partition body may be provided to form the communication space for the communication between the first region and the second region, and thus, the foaming liquid injected through the injection portion may be easily filled not only into the second region but also into the first region through the communication space.

In addition, since the replacement of the cabinet cover is performed simply and quickly, the user's reluctance to replace the cabinet cover may be reduced, and the user's desire to replace the cabinet cover may be easily satisfied.

In addition, even if the user unintentionally pulls the cabinet cover forward by the coupling member, the unintentional separation of the cabinet cover may be prevented.

MODE FOR CARRYING OUT THE INVENTION

Reference will now be made in detail to the embodiments of the present invention, examples of which are illustrated in the accompanying drawings.

Figure 1:
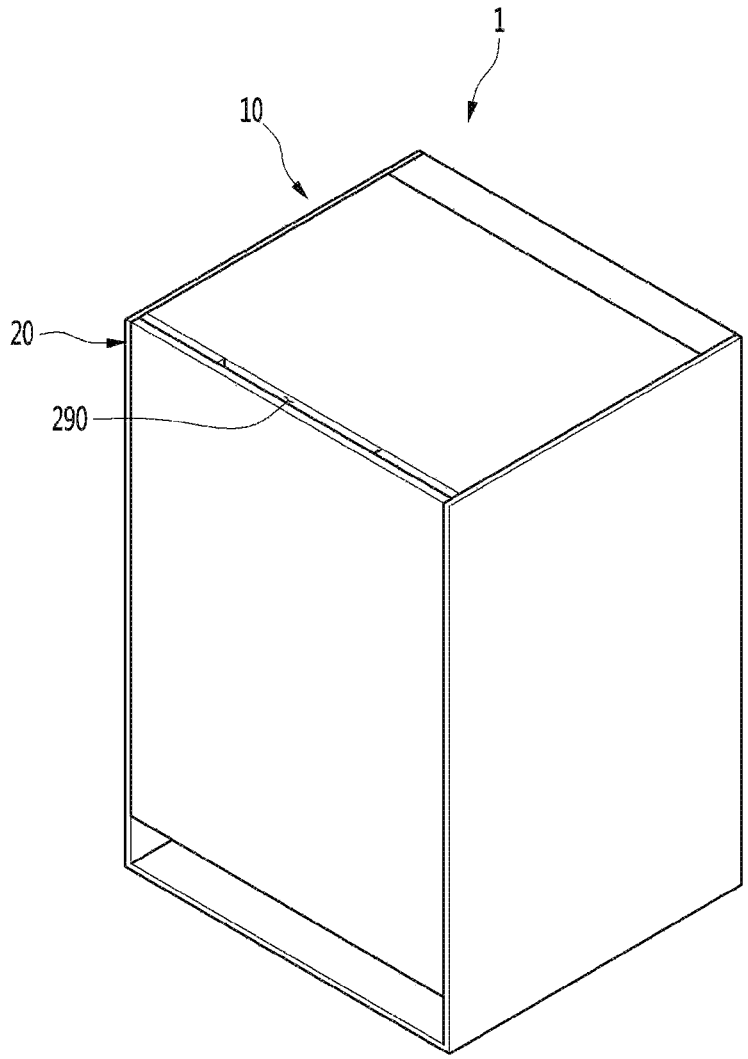
FIG. 1 is a perspective view of a refrigerator according to an embodiment of the present invention.
Figure 2:
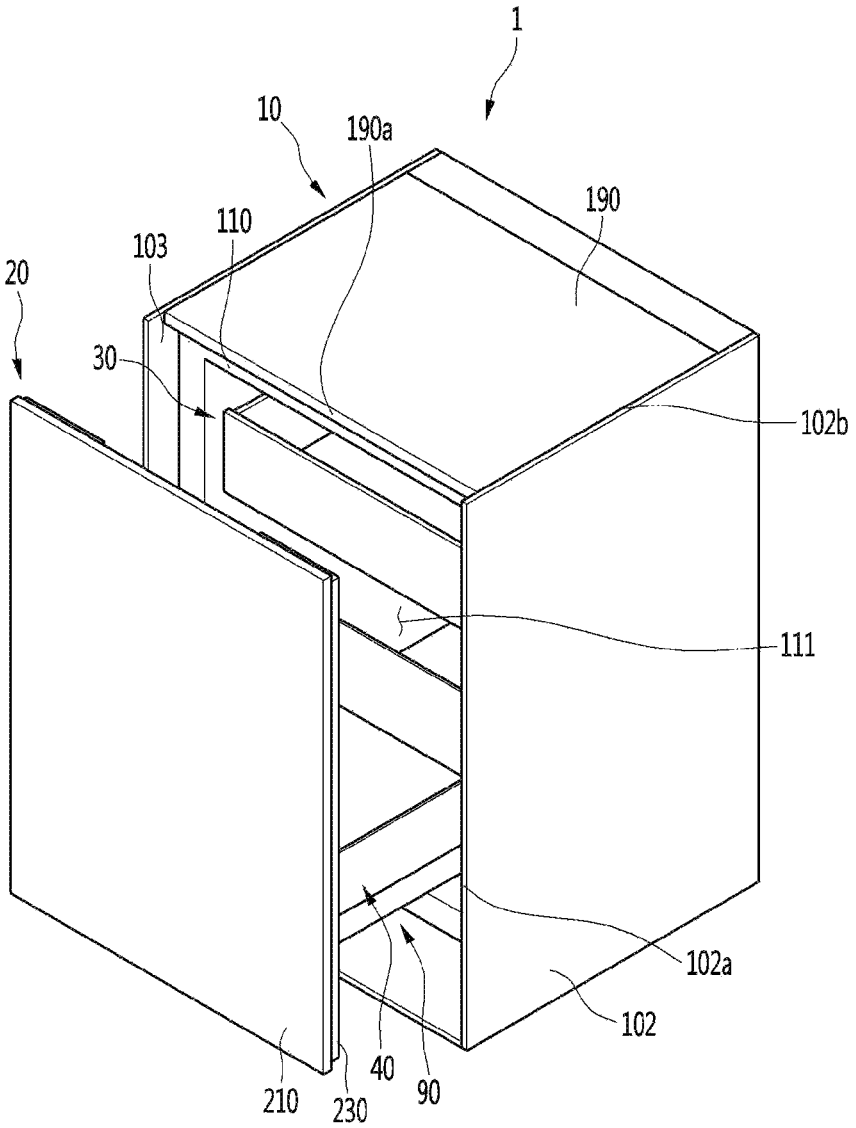
FIG. 2 is a perspective view illustrating a state in which a door is opened in FIG. 1.
Figure 3:
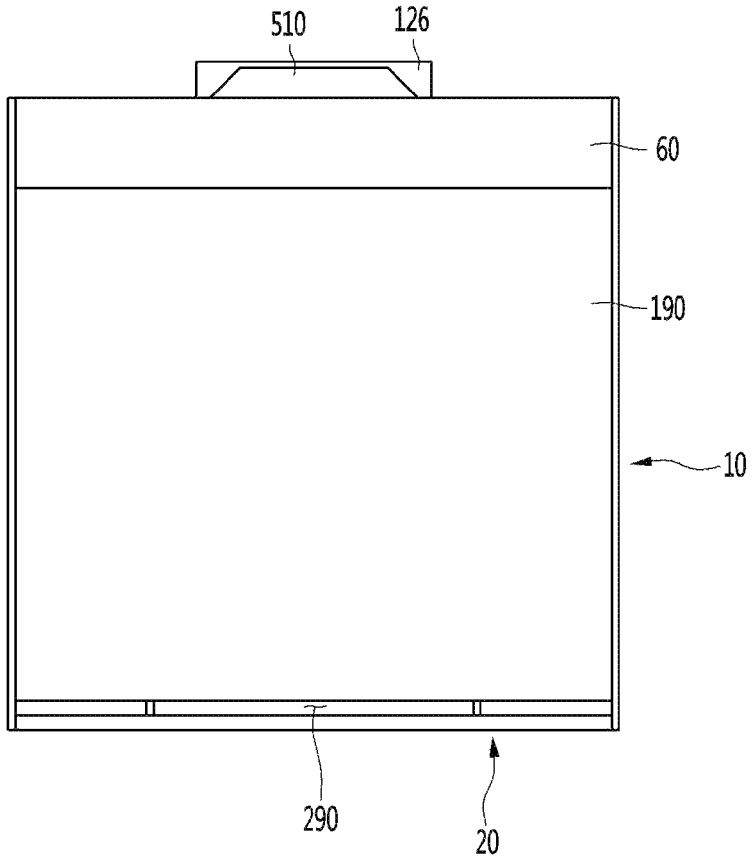
FIG. 3 is a plan view of the refrigerator of FIG. 1.

FIG. 1 is a perspective view of a refrigerator according to an embodiment of the present invention, FIG. 2 is a perspective view illustrating a state in which a door is opened in FIG. 1, and FIG. 3 is a plan view of the refrigerator of FIG. 1.

Referring to FIGS. 1 to 3, a refrigerator 1 according to an embodiment of the present invention may include a cabinet 10 provided with a storage space 111 and a door 20 connected to the cabinet 10 to open and close the storage space 111.

The cabinet 10 may include an inner case 110 defining the storage space 111 and an outer case 100 surrounding the inner case 110.

The outer case 100 may be made of a metal material. For example, the outer case 100 may be made of an aluminum (Al) material. The outer case 100 may be formed by being bent at least twice or bent. Alternatively, the outer case 100 may be formed by bonding a plurality of metal plates.

For example, the outer case 100 may include a pair of side panels 102 and 103.

The pair of side panels 102 and 103 may be arranged in a horizontal direction. In detail, the side panels 102 and 103 may include a right side panel 102 and a left side panel 103 with respect to a direction that is directed from the door 20 to the storage space 111.

Here, a direction that is directed from the door 20 to the storage space 111 may be defined as "a rear side", and a direction that is directed from the storage space 111 to the door 20 may be defined as a "front side". That is, the storage space 111 may be disposed at the rear side of the door 20.

The inner case 110 may be directly or indirectly fixed to the outer case 100 in a state of being disposed between the pair of side panels 102 and 103.

A front end 102*a* of each of the pair of side panels 102 and 103 may be disposed in front of the front surface of the inner case 110, rather than a front surface of the inner case 110.

A horizontal width of the door 20 may be equal to or less than a distance between the pair of side panels 102 and 103.

Thus, a space in which the door 20 is disposed may be defined between the pair of side panels 102 and 103.

For example, in a state in which the door 20 closes the storage space 111, the door 20 may be disposed between the pair of side panels 102 and 103.

Here, in a state in which the door 20 closes the storage space 111, the front surface of the door 20 may be disposed on the same plane as the front end 102*a* of each of the side panels 102 and 103 so that the outer appearances of the door 20 and the cabinet 10 have a sense of unity.

That is, the front surface of the door 20 and the front end 102*a* of each of the side panels 102 and 103 may define the outer appearance of the front surface of the refrigerator 1.

The door 20 may be connected to, for example, the cabinet 10 by a rail assembly 90.

Thus, the door 20 may open and close the storage space 111 while moving in a forward and backward sliding manner in a state of being connected to the cabinet 10.

According to the present invention, even when the refrigerator 1 is disposed in a narrow space such as a kitchen, living room, or room, since the door 20 opens and closes the storage space 111 in the sliding manner, the door 20 may be opened without interfering with surrounding structures.

One side of the rail assembly 90 may be connected to the door 20, and the other side may be connected to the inner case 110.

The door 20 may include a front panel 210 made of a wood material and a door liner 230 coupled to a rear surface of the front panel 210.

The front panel 210 and the door liner 230 may be coupled to each other by, for example, a coupling member such as a screw. The front panel 210 and the door liner 230 may define a foaming space, and as a foaming liquid is filled in the foaming space, an insulating material may be provided between the front panel 210 and the door liner 230.

In order to open the door 20, the door 20 may define a space 290 for a handle into which a user's hand is inserted so that the user holds the door 20.

The space 290 for the handle may be defined, for example, as a portion of an upper portion of the door liner 230 is recessed downward.

The space 290 for the handle may be disposed between the front panel 210 and the cabinet 10 in a state in which the door 20 closes the storage space 111. Thus, the user may open the door 20 by pulling the door 20 after inserting the hand into the space 290 for the handle in the state in which the door 20 closes the storage space 111.

According to the present invention, since a structure such as the handle does not protrude to the outside in the state in which the door 20 is closed, the aesthetics of the refrigerator 1 may be improved.

A height of the refrigerator 1 is not limited, but may be less than that of a general adult. As a capacity of the refrigerator 1 decreases, the height of the refrigerator 1 may decrease.

As in the present invention, when the space 290 for the handle exists above the door 20, even if the height of the refrigerator 1 decreases, the user may easily open the door 20 in a standing or sit state.

The upper end 102*b* of each of the pair of side panels 102 and 103 may be disposed higher than an upper end of the inner case 110.

Thus, a space may be defined above the inner case 110, and a cabinet cover 190 may be disposed in the space. The cabinet cover 190 may define an outer appearance of a top surface of the cabinet 10. That is, the cabinet cover 190 defines the outer appearance of the top surface of the refrigerator 1.

The cabinet cover 190 may be fixed to the middle plate 150 surrounding the inner case 110. For example, the cabinet cover 190 may be coupled to the middle plate 150 by a coupling member S1 to be described later.

In a state in which the cabinet cover 190 covers the inner case 110, the cabinet cover 190 may be disposed between the pair of side panels 102 and 103.

A top surface of the cabinet cover 190 may be disposed on the same plane or at the same height as the upper end 102*b* of each of the side panels 102 and 103 so that the outer appearances of the cabinet cover 190 and the cabinet 10 have a sense of unity.

The cabinet cover 190 may be made of, for example, a wood material.

According to the present invention, since each of the front panel 210 and the cabinet cover 190 of the door 20 is made of the wood material, in the state in which the door 20 is closed, there is an advantage in that there is a uniformity in material between the door 20 and the cabinet cover 190 to improve aesthetics.

Furthermore, when the height of the refrigerator 1 is low, the user may visually check the cabinet cover 190. Thus, since the cabinet cover 190 is made of the wood material, there may be an advantage of forming a sense of unity with surrounding furniture in which the refrigerator 1 is disposed as well as providing basic aesthetic feeling.

The refrigerator 1 of the present invention may be used, for example, as a side table refrigerator.

The side table refrigerator may serve as a side table in addition to a function of storing food. Unlike the general refrigerator that is often provided in the kitchen, the side table refrigerator may be used next to the bed in the bedroom. According to the present invention, since each of the cabinet cover 190 and the front panel 210 is made of the wood material, even if the refrigerator 1 is disposed in the bedroom, it may be harmonized with the surrounding furniture.

For the convenience of the user, a height of the side table refrigerator may be preferably similar to that of the bed, for example, and may be formed to have a height less than that of the general refrigerator and to be compact.

In addition, as the refrigerator 1 is used as the side table refrigerator, the user may place various objects on the cabinet cover 190, and in such a situation, the cabinet cover 190 may be damaged.

As an example, a case in which a liquid or the like is spilled on the cabinet cover 190, or an object having a sharp surface collides with the cabinet cover 190 may occur.

When the cabinet cover 190 is damaged, it may be necessary to replace the cabinet cover 190 in the refrigerator 1. According to the fixing structure of the present invention, which will be described later, since it is possible to provide a service to easily replace the cabinet cover 190, user satisfaction and service satisfaction may be improved.

In addition, as the refrigerator 1 is used as a side table refrigerator, a design of the cabinet cover 190 may be utilized as an interior of a space in which the refrigerator 1 is installed. According to structure of the present invention, since the cabinet cover 190 is easily replaced, user's desire to replace the cabinet cover 190 for the interior may be satisfied.

The front surface 190*a* of the cabinet cover 190 may be disposed in front of the front surface of the inner case 110. Thus, in the state in which the door 20 closes the storage space 111, the cabinet cover 190 may cover a portion of the door liner 230 from the upper side.

The refrigerator 1 may further include a display unit 60 installed at a rear side of an upper end of the cabinet 10 and one or more drawer assemblies 30 and 40 that are accommodated in the storage space 111. A plurality of drawer assemblies 30 and 40 may be provided in the storage space 111 in order to improve efficiency of the storage space.

The display unit 60 may be disposed at a rear side of the cabinet cover 190. A user may manipulate an operation of the refrigerator 1 or check a state of the refrigerator 1 by using the display unit 60.

The display unit 60 may be installed to be disposed between a pair of side panels 102 and 103. For example, the display unit 60 may be installed by being coupled to the pair of side panels 102 and 103 by a coupling member or the like.

In addition, the display unit 60 may be firmly coupled to a rear panel 160 to be described later by screw coupling.

Some of the plurality of drawer assemblies 30 and 40 may exist in a fixed position in the storage space 111 or may be connected to a rail and slidably disposed by the rail.

Alternatively, some of the plurality of drawer assemblies 30 and 40 may be connected to the door 20 so as to be slidably inserted and withdrawn together with the door 20.

Alternatively, some of the plurality of drawer assemblies 30 and 40 may be configured to be slidably withdrawn together with the door 20 at an initial stage of opening during the process of opening the door 20 and also to be stopped at a position that is withdrawn by a predetermined distance.

Hereinafter, the structure of the cabinet 10 will be described in detail.

In this case, the components constituting the cabinet 10 will be described in detail based on the process of assembling the cabinet 10.

Figure 4:
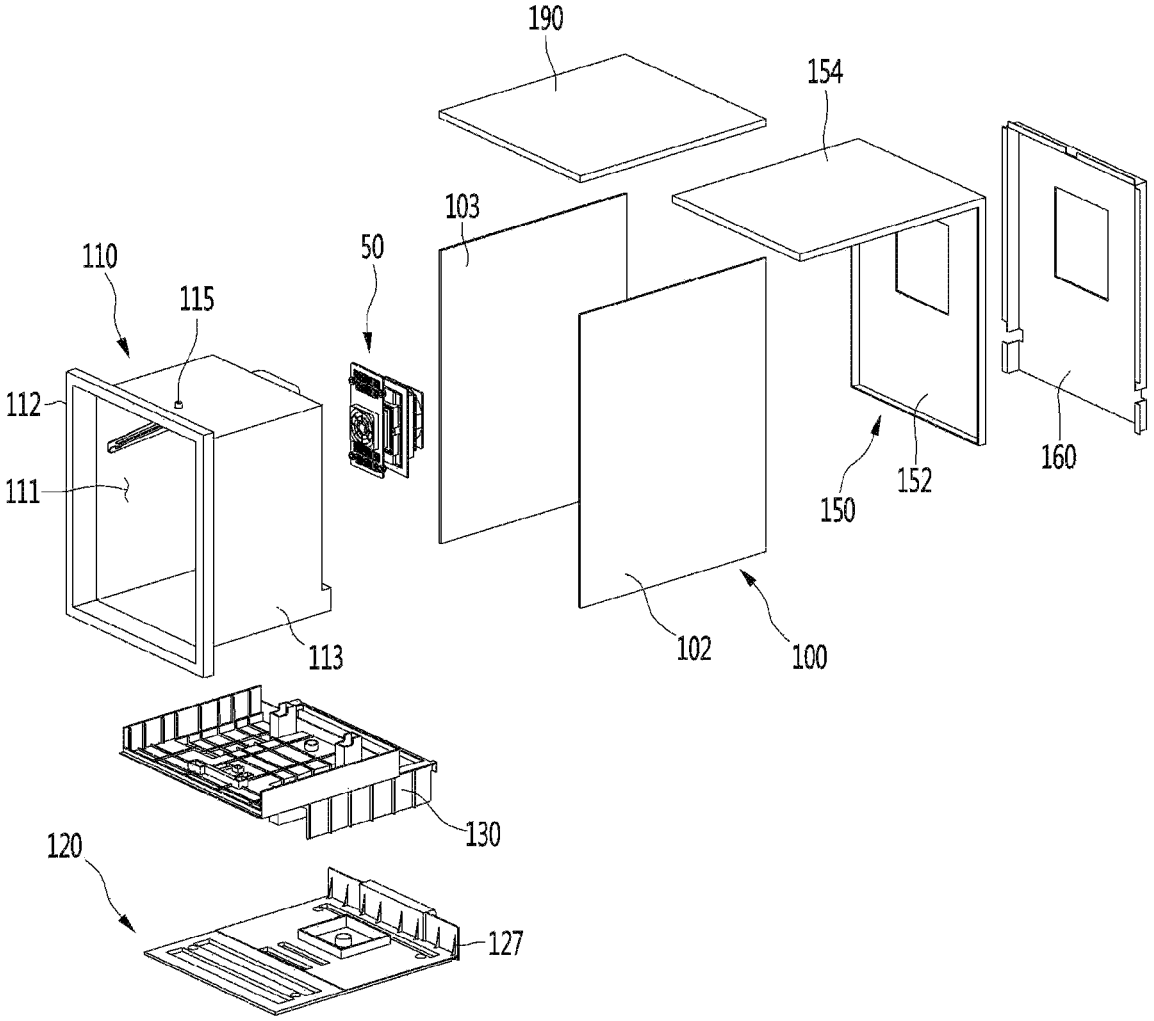
FIG. 4 is an exploded perspective view of a cabinet according to an embodiment of the present invention.

FIG. 4 is an exploded perspective view of the cabinet according to an embodiment of the present invention.

Referring to FIGS. 1 to 4, the cabinet 10 according to an embodiment of the present invention may include an outer case 100, an inner case 110, and a cabinet cover 190.

The outer case 100 may include a pair of side panels 102 and 103. The pair of side panels 102 and 103 may define an outer appearance of a side surface of the refrigerator 1.

The outer case 100 may further include a rear panel 160 defining an outer appearance of a rear surface of the refrigerator 1.

Thus, the outer appearance of the refrigerator 1 excluding the door 20 may be defined by the pair of side panels 102 and 103, the cabinet cover 190 and the rear panel 160.

The cabinet 10 may further include a case supporter 130 supporting the inner case 110 and a base 120 coupled to a lower side of the case supporter 130.

The cabinet 10 may further include a middle plate 150 defining a foaming space 159 together with the inner case 110. The middle plate 150 may cover upper and rear sides of the inner case 110 at a position that is spaced apart from the inner case 110.

As a foaming liquid is filled in a foaming space 159, an insulating material may be provided between the inner case 110 and the middle plate 150.

The cabinet 10 may further include a cooling device 50 cooling the storage space 111.

The base 120 may further include a support rib 127 supporting the rear panel 160. The support rib 127 may extend upward from a rear end of the base 120. A handle 126 held by the user may be provided on a rear surface of the support rib 127.

The handle 126 may be gripped when the user wants to transport the refrigerator 1. As the handle 126 is provided on the support rib 127, the handle 126 is not visible from the outside when the refrigerator 1 is installed.

The rear surface of the support rib 127 may be disposed on the same plane as the rear end of each of the pair of side panels 102 and 103.

The handle 126 may protrude backward by a predetermined distance from the rear surface of the support rib 127.

The inner case 110 may include a main frame 113 defining the storage space 111 and a front frame 112 extending in a vertical direction from a front edge of the main frame 113.

The main frame 113 may be formed in a rectangular parallelepiped shape having an opened front surface.

A front and rear length of the main frame 113 may be less than that of each of the side panels 102 and 103. In addition, a horizontal width of the main frame 113 may be formed to be less than an interval between the respective side panels 102 and 103. On the other hand, the horizontal width of the front frame 112 may be formed to have the same as the interval between the side panels 102 and 103.

When the inner case 110 is installed at the installation position, both side surfaces of the main frame 113 are spaced apart from the side panels 102 and 103, respectively. Thus, the foaming space 159 in which a foaming liquid is filled is defined between both the side surfaces of the main frame 113 and the respective side panels 102 and 103.

The front frame 112 may further include a horizontal extension portion 112*a* for allowing a contact area with each of the side panels 102 and 103 to increase. The horizontal extension portion 112*a* may extend backward from an edge of the front frame 113.

In the process of filling the foaming liquid into the foaming space 159, both side surfaces of the horizontal extension portion 112*a* of the front frame 112 may be respectively attached to the side panels 102 and 103 by an adhesive means to prevent the foaming liquid from leaking between each of the side panels 102 and 103 and the front frame 112.

In a state in which the inner case 110 is seated on the case supporter 130, an upper end of the front frame 112 is disposed to be lower than the upper end 102*b* of each of the side panels 102 and 103. Thus, a space in which the cabinet cover 190 is disposed is defined above the front frame 112.

A partition member 115 providing a movement path of the coupling member S1 may be provided in the inner case 110. The partition member 115 may provide the moving path 116*a* (see FIG. 11) in the foaming space 159.

The foaming space 159 may be partitioned by the partition member 115. The foaming space 159 may be divided into the inside and outside of the partition member 115.

The inside of the partition member 115 may form the moving path, and the coupling member may be accessible through the moving path 116*a*, and thus the middle plate 150 and the cabinet cover 190 may be coupled, and the coupling between the middle plate 150 and the cabinet cover 190 may be released.

Thus, the cabinet cover 190 may be coupled by the coupling member S1 inserted through the moving path of the partition member 115 to prevent forward or rearward movement. The fixing of the cabinet cover 190 by the partition member 115 and the coupling member S1 will be described later in detail.

The middle plate 150 may cover the inner case 110 from the rear side of the inner case 110.

The middle plate 150 may include a rear plate 152 covering a rear surface of the inner case 110 and an upper plate 154 covering a top surface of the inner case 110.

The upper plate 154 may extend horizontally from an upper end of the rear plate 152. Thus, the middle plate 150 may be formed in a shape such as "¬".

The upper plate 154 may be seated on an upper end of the front frame 112. For example, the upper plate 154 may be attached to a top surface portion of the horizontal extension portion 112*a* of the front frame 112 by an adhesive means.

In a state in which the upper plate 154 is seated on the front frame 112, the upper plate 154 is spaced apart from the top surface of the main frame 113. Thus, the foaming space 159 is defined between the upper plate 154 and the top surface of the main frame 113.

The rear plate 152 may be coupled to the case supporter 130.

The rear plate 152 may be installed on the base 120 and the pair of side panels 102 and 103.

A coupling rib (not shown) extending upward to install the rear plate 152 may be provided on the base 120. The coupling rib may be disposed at a relatively rear side rather than the rear surface of the main frame 113.

A coupling hole (not shown) for coupling of a bolt may be defined in the rear plate 152 and the coupling rib.

The rear plate 152 may be fixed to the base 120 by being coupled to the coupling rib by the bolt in a state of being in contact with a rear surface of the coupling rib.

The rear plate 152 may be spaced apart from the rear surface of the main frame 113. Thus, the foaming space 159 is defined between the rear plate 152 and the rear surface of the main frame 113.

An injection hole (not shown) for injection of the foaming liquid may be defined in the rear plate 152, and the injection hole may be blocked by a packing (not shown).

In a state in which the assembly of the middle plate 150 is completed, a top surface of the upper plate 154 may be disposed lower than the upper end 102*b* of each of the side panels 102 and 103. Thus, a space, in which the cabinet cover 190 is disposed, may be defined above the upper plate 154.

In addition, in a state in which the installation of the middle plate 150 is completed, the rear surface of the rear plate 152 is disposed to be spaced inward from the rear end of each of the side panels 102 and 103. Thus, there is a space (rear heat dissipation passage) through which air for heat dissipation of the cooling device 50 flows at the rear side of the rear plate 152.

The rear panel 160 may cover the rear plate 152 from the rear side of the rear plate 152.

The rear panel 160 may be coupled to the case supporter 130 at the rear side of the rear plate 152 in a state of being spaced apart from the rear plate 152. The rear panel 160 may be disposed above the support rib 127 and coupled to the case supporter 130 by a coupling member such as a screw.

A coupling hole (not shown) for coupling with the case supporter 130 may be defined in a lower portion of the rear panel 160.

An external air hole (not shown) through which external air is introduced may be defined in the rear panel 160, and the external air hole may be covered by a grill case 510 (see FIG. 3). The grill case 510 may be coupled to the rear panel 160 from the rear side of the rear panel 160.

The grill case 510 may be supported by being seated on the top surface of the handle 126.

Figure 5:
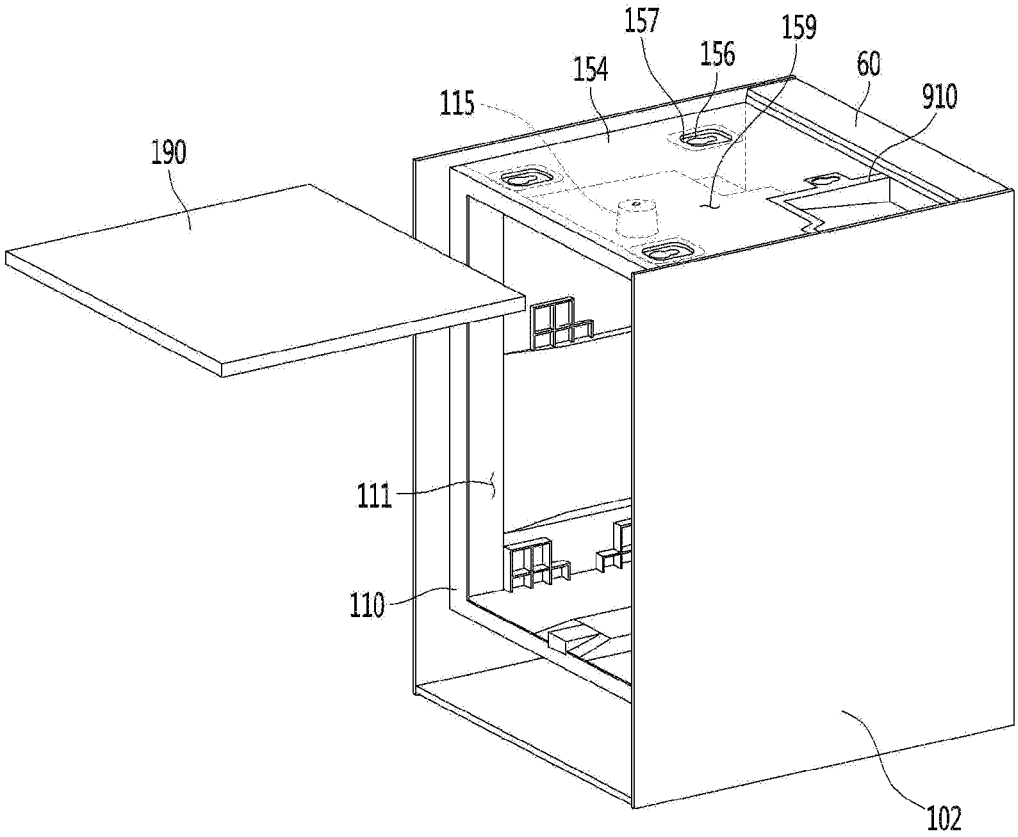
FIG. 5 is a perspective view of the refrigerator in a state in which a cabinet cover is disassembled according to an embodiment of the present invention.
Figure 6:
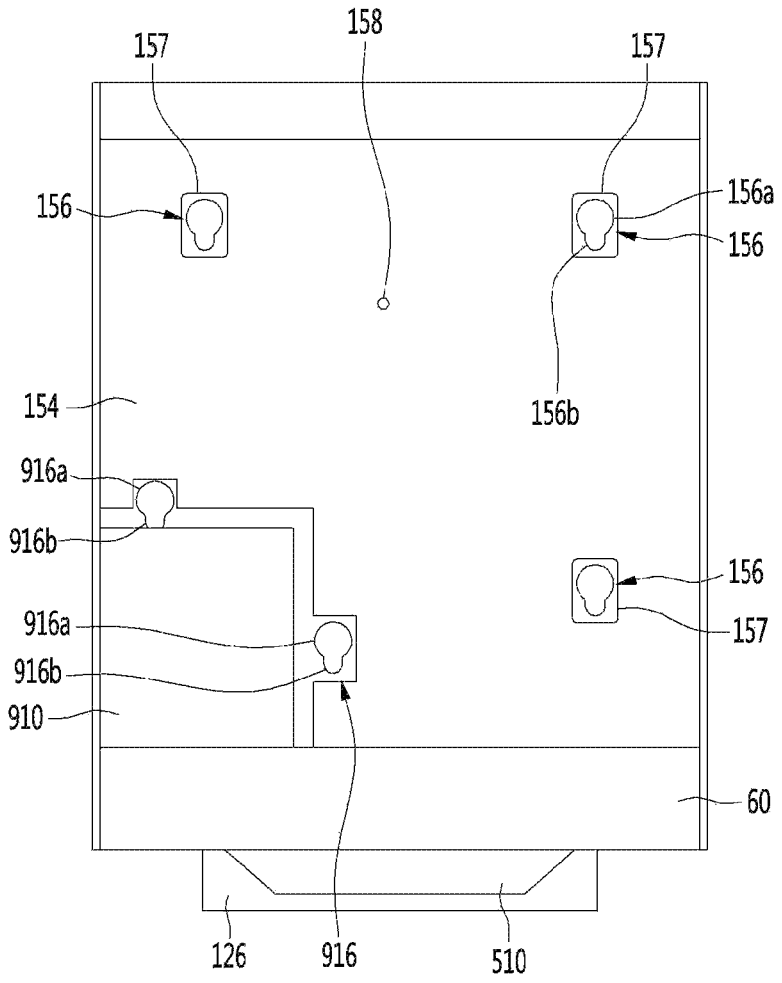
FIG. 6 is a view of the refrigerator, in which the cabinet cover is disassembled, when viewed from an upper side.
Figure 7:
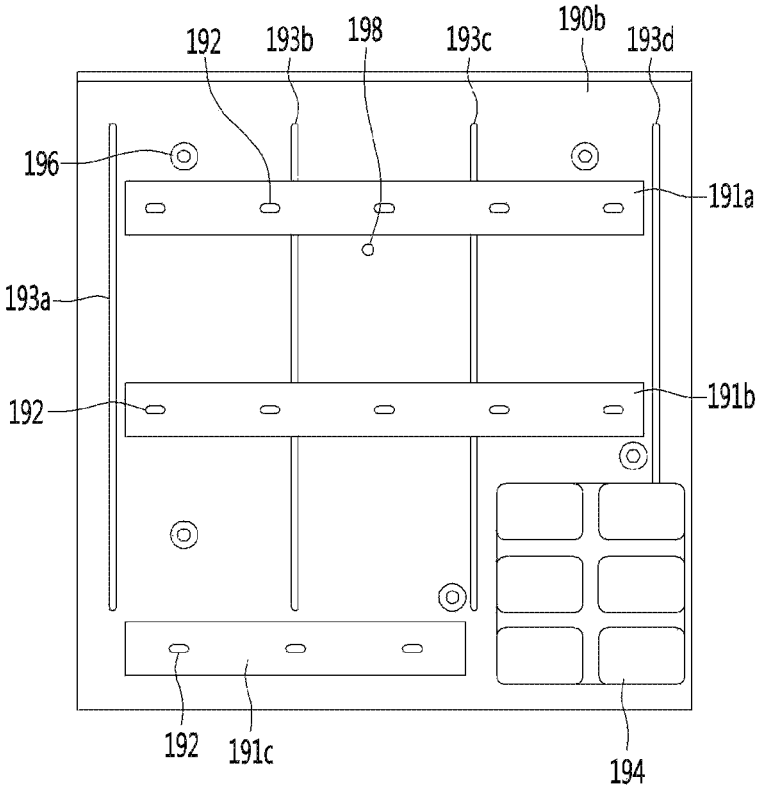
FIG. 7 is a plan view illustrating a bottom surface of the cabinet cover.
Figure 8:
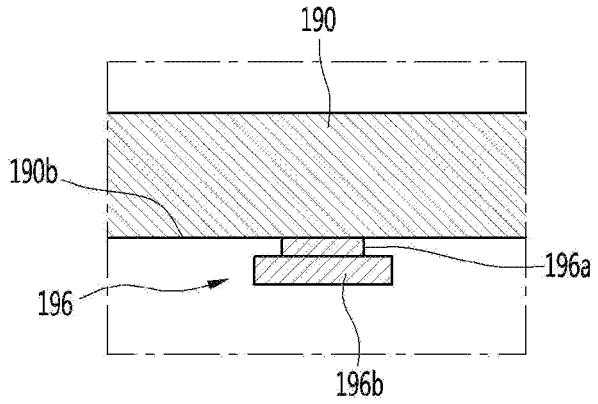
FIG. 8 is a cross-sectional view of a cover fixing portion of the cabinet cover according to an embodiment of the present invention.

FIG. 5 is a perspective view of the refrigerator in a state in which the cabinet cover is disassembled according to an embodiment of the present invention, FIG. 6 is a view of the refrigerator, in which the cabinet cover is disassembled, when viewed from an upper side, FIG. 7 is a plan view illustrating a bottom surface of the cabinet cover, and FIG. 8 is a cross-sectional view of a cover fixing portion of the cabinet cover according to an embodiment of the present invention.

Referring to FIGS. 5 to 8, the cabinet cover 190 may include a reinforcing portion 191, a groove 193, and a module accommodation portion 194.

The reinforcing portion 191, the groove 193, and the module accommodation portion 194 may be provided on the bottom surface 190*b* of the cabinet cover 190.

The reinforcing portion 191 may be formed to extend on the bottom surface 190*b* of the cabinet cover 190 in a horizontal direction. A plurality of reinforcing portions 191 may be provided.

Each of the plurality of reinforcing portions 191 may be less than a horizontal lengths of the cabinet cover 190.

In addition, the reinforcing portion 191 formed at a side of the module accommodation portion 194 among the plurality of reinforcing portions 191 may be provided to have a length that does not interfere with the module accommodation portion 194.

The reinforcing portions 191 may include first and second reinforcing portions 191*a* and 191*b*, each of which has a length corresponding to the horizontal length of the cabinet cover 190 and a third reinforcing portion 191*c* having a length less than that of each of the first and second reinforcing portions 191*a* and 191*b*.

The first, second, and third reinforcing portions 191*a*, 191*b*, and 191*c* may be disposed to be spaced regular intervals from each other in the forward and backward direction.

The third reinforcing portion 191*c* is disposed at a side of the module accommodation portion 194 and has a length that does not interfere with the module accommodation portion 194.

A distance between the first reinforcing portion 191*a* and the front surface 190*a* of the cabinet cover 190 may be less than that between the second reinforcing portion 191*b* and the front surface 190*a* of the cabinet cover 190.

The second reinforcing portion 191*b* is disposed between the first reinforcing portion 191*a* and the third reinforcing portion 191*c*.

A recessed portion (not shown) may be formed in the bottom surface 190*b* of the cabinet cover 190. Thus, the reinforcing portion 191 may be installed so that at least a portion thereof is inserted into the recessed portion of the cabinet cover 190.

In the state in which the reinforcing portion 191 is disposed in the recessed portion formed in the bottom surface 190*b* of the cabinet cover 190, the bottom surface 190*b* of the cabinet cover 190 and a bottom surface of the reinforcing portion 191 may be disposed on the same plane.

A coupling hole 192 through which a screw fixed to the cabinet cover 190 passes may be defined in the reinforcing portion 191.

The groove 193 may be formed in the bottom surface 190*b* of the cabinet cover 190 to extend in the forward and backward direction. The groove 193 may be formed by being recessed upward from the bottom surface 190*b* of the cabinet cover 190.

A plurality of the grooves 193 may be formed.

The plurality of grooves 193 may be formed to have a length less than that of the cabinet cover 190 in the forward and backward direction.

In addition, the groove 193 disposed in front of the module accommodation portion 194 among the plurality of grooves 193 may be formed to have a length that does not interfere with the module accommodation portion 194.

The groove 193 may include first, second, and third cutoff grooves 193*a*, 193*b*, and 193*c* and a fourth cutoff groove 193*d* formed to have a length less than that of each of the first, second, and third cutoff grooves 193*a*, 193*b*, and 193*c*. The first, second, third, and fourth cutoff grooves 193*a*, 193*b*, 193*c*, and 193*d* may be disposed to be spaced regular intervals from each other in the horizontal direction.

Referring to FIG. 7, the first cutoff groove 193*a* may be disposed at the leftmost side, the second cutoff groove 193*b* may be disposed at a right side of the first cutoff groove 193*a*, and the third cutoff groove 193*c* may be disposed at a right side of the second cutoff groove 193*b*.

The fourth cutoff groove 193*d* may be disposed at a right side of the third cutoff groove 193*c* and may be formed to have a length less than that of each of the first, second, and third cutoff grooves 193*a*, 193*b*, and 193*c*. That is, the fourth cutoff groove 193*d* may not interfere with the module accommodation portion 194.

The groove 193 may extend in a direction crossing the reinforcing portion 191.

Although not shown, the module accommodation portion 194 may accommodate a wireless charging module. The module accommodation portion 194 may be formed as it is recessed upward from the bottom surface 190*b* of the cabinet cover 190.

The module accommodation portion 194 may be formed to have a size corresponding to that of a top surface of the wireless charging module.

The module accommodation portion 194 may be disposed at a rear corner in a state in which the cabinet cover 190 is assembled.

A thickness between the module accommodation portion 194 and the top surface of the cabinet cover 190 is less than that of the cabinet cover 190, in which the module accommodation portion 194 is not formed, by the module accommodation portion 194.

A recessed depth of the module accommodation portion 194 may be formed so that a distance between a mobile device to be placed on the cabinet cover 190 and the wireless charging module becomes a distance at which wireless charging of the mobile device is possible.

The refrigerator 1 according to an embodiment of the present invention may include a fixing structure for fixing the cabinet cover 190.

The fixing structure may include a cover fixing portion 196 for fixing the cabinet cover 190 to the middle plate 150 and cover fixing holes 156 and 916 for fixing the cover fixing portion 196.

The cabinet cover 190 may be detachably coupled to the middle plate 150. In detail, as the cover fixing portion 196 provided on the cabinet cover 190 is inserted into the cover fixing holes 156 and 916 defined below the cabinet cover 190, the cabinet cover 190 may be attached to and detached from the middle plate 150.

The cover fixing portion 196 may be provided on a bottom surface 190*b* of the cabinet cover 190.

For example, the cover fixing portion 196 may be attached to the bottom surface 190*b* of the cabinet cover 190 by an adhesive means. The adhesive means may include an adhesive or a double-sided tape, and it is noted that there is no limitation in types of the adhesive means in the present invention.

As another example, the cover fixing portion 196 may be fixed to the bottom surface 190*b* of the cabinet cover 190 by a screw.

In order to firmly fix the cabinet cover 190 to the middle plate 150, a plurality of cover fixing portions 196 may be provided.

The plurality of cover fixing portions 196 may be arranged to be spaced apart from each other in the horizontal direction of the cabinet cover 190 and may be arranged to be spaced apart from each other in the front and rear direction.

For example, five cover fixing portions 196 may be provided. A portion of the cover fixing portion 196 may be disposed adjacent to the door 20, another portion may be disposed adjacent to the display unit 60, and further another portion may be disposed adjacent to the module accommodation portion 194 to be described later.

The cover fixing portion 196 may be provided at a position that does not overlap the reinforcing portion 191.

Referring to FIG. 8, each of the cover fixing portions 196 may include a first portion 196*a* and a second portion 196*b* having a diameter or a size greater than that of the first portion 196*a*.

The first portion 196*a* is disposed between the cabinet cover 190 and the second portion 196*b*, and the first portion 196*a* is in contact with the bottom surface 190*b* of the cabinet cover 190.

The refrigerator 1 may further include a module mounting case 910 for mounting the wireless charging module capable of wirelessly charging a battery of the mobile device.

The module mounting case 910 may be disposed in a cutoff portion (not shown) formed in the middle plate 150. The cutoff portion may be formed in an upper corner of the middle plate 150.

The module mounting case 910 may be disposed at an upper side of the rear surface of the refrigerator 1. That is, a portion of the module mounting case 910 may be disposed on the upper plate 154.

A plurality of cover fixing holes 156 and 916 may be defined.

At least a portion of the plurality of cover fixing holes 156 and 916 may be formed in the middle plate 150. For example, the cover fixing hole 156 may be provided in the upper plate 154.

Also, the cover fixing hole 916 may be formed in the module mounting case 910. However, when the module mounting case 910 is not provided in the refrigerator 1, all of the cover fixing holes 156 may be formed in the middle plate 150.

The cover fixing hole 916 for coupling with the cabinet cover 190 may be defined in the module mounting case 910. The cover fixing hole 916 may be disposed in an edge of the module mounting case 910.

For example, the module mounting case 910 may include an extension portion extending in the horizontal direction from an upper edge, and the cover fixing hole 916 may be defined in the extending portion according to the extension portion.

A plurality of cover fixing holes 916 may be defined. For example, the plurality of cover fixing holes 916 may be formed at front and side ends of the module mounting case 910 that are coupled to the middle plate 150.

The cover fixing hole 156,916 may include first holes 156*a* and 916*a* having a size equal to or greater than that of the second portion 196*b* of the cover fixing portion 196 and second holes 156*b* and 916*b* extending from the first holes 156*a* and 916*a* and each having a size less than that of each of the first holes 156*a* and 916*a*.

The second holes 156*b* and 916*b* may extend from the first holes 156*a* and 916*a* toward the rear panel 160. The second holes 156*b* and 916*b* may be disposed closer to the rear panel 160 than the first holes 156*a* and 916*a*. That is, the second holes 156*b* and 916*b* are disposed behind the first holes 156*a* and 916*a*.

Each of the second holes 156*b* and 916*b* may be defined to be less than the second portion 196*b* of the cover fixing portion 196. In addition, each of the second holes 156*b* and 916*b* may have a size that is equal to or greater than that of the first portion 196*a* of the cover fixing portion 196.

In order to fix the cover fixing portion 196 to the middle plate 150 and the module mounting case 910, the second portion 196*b* of the cover fixing portion 196 and the first holes 156*a* and 916*a* of the cover fixing holes 156 and 916 are aligned with each other. Next the second portion 196*b* of the cover fixing portion 196 passes through the first holes 156*a* 916*a* of the cover fixing holes 156 and 916.

In the state in which the second portion 196*b* of the cover fixing portion 196 passes through the first hole 156*a* and 916*a* of the cover fixing hole 916, the first portion 196*a* of the cover fixing portion 196 is disposed within the first holes 156*a* and 916*a*, and the cabinet cover 190 is seated on the upper plate 154.

In this state, the cabinet cover 190 horizontally moves so that the first portion 196*a* of the cover fixing portion 196 is disposed in the second holes 156*b* and 916*b* of the cover fixing holes 156 and 916.

Since the second holes 156*b* and 916*b* are disposed behind the first holes 156*a* and 916*a*, the cabinet cover 190 may move backward.

When the first portion 196*a* of the cover fixing portion 196 is disposed in the second hole 156*b* of the cover fixing holes 156 and 916, the second portion 196*b* is in contact with a bottom surface 154 of the upper portion 154.

Thus, the separation of the cabinet cover 190 from the middle plate 150 may be prevented unless the cabinet cover 190 is pushed forward (to a front side).

In the present invention, since the cabinet cover 190 is coupled to the middle plate 150 in a sliding manner, the cabinet cover 190 may be easily coupled to the middle plate 150 and easily separated from the middle plate 150.

Thus, according to the present invention, there is an advantage that the cabinet cover 190 is capable of being replaced. That is, since the cabinet cover 190 having a design or color desired by the user is coupled to the middle plate 150, there is an advantage that the design of the outer appearance of the refrigerator 1 may be diversified.

When the assembly of the cabinet cover 190 is completed, the rear surface of the cabinet cover 190 may be disposed inside the rear end of each of the side panels 102 and 103.

In addition, in the state in which the assembly of the cabinet cover 190 is completed, the rear surface of the cabinet cover 190 may be in contact with the front surface of the display unit 60.

That is, in the state in which the cover fixing portion 196 is disposed in the second holes 156*b* and 916*b* of the cover fixing holes 156 and 916, the top surface of the cabinet cover 190 and the top surface of the display unit 60 may form a continuous surface to provide a sense of unity.

A recessed portion 157 may be formed in the middle plate 150 to cover a thickness of the cover fixing portion 196. The recessed portion 157 may be formed on a top surface of the upper plate 154.

The recessed portion 157 may be formed by being recessed downward from the top surface of the upper plate 154.

The recessed portion 157 may be formed to surround the cover fixing hole 156. That is, as the cover fixing hole 156 is formed in the recessed portion 157, the cover fixing hole 156 may be disposed below the top surface of the upper plate 154.

A depth of the recessed portion 157 may be formed to correspond to a length of the cover fixing portion 196. In detail, a depth of the recessed portion 157 may be formed to correspond to a vertical length of the first portion 196*a* of the cover fixing portion 196.

For example, the depth of the recessed portion 157 may be equal to or greater than the vertical length of the first portion 196*a*. Thus, when the cover fixing portion 196 is coupled to the cover fixing hole 156, the cabinet cover 190 may be in close contact with the middle plate 150.

In the case of an embodiment of the present invention, when the coupling member S1 is coupled to the cabinet cover 190 in the state in which the assembly of the cabinet cover 190 is completed, even if the cabinet cover 190 is pushed forward, the cabinet cover 190 may be prevented from being separated.

Also, a coupling hole 158 through which the coupling member S1 passes may be defined in the middle plate 150.

In addition, an entrance hole 113*a* for an access of the coupling member S1 may be formed in the inner case 110. The entrance hole 113*a* may be formed by passing through the top surface of the main frame 113.

In the present embodiment, an insulating material may be disposed between the inner case 110 and the middle plate 150. The refrigerator 1 of the present embodiment may further include a structure for allowing a user or a service provider to be easily accessible to the coupling member S1 after assembly of the refrigerator is completed.

For example, the coupling member S1 may be a "coupling member S1".

For example, the inner case 110 may include a partition member 115 for dividing a space between the inner case 110 and the middle plate 150 into two spaces.

The partition member 115 may extend from the inner case 110 toward the middle plate 150. For example, the partition member 115 may extend upward from the top surface of the inner case 110.

In detail, the partition member 115 may extend upward from the top surface of the main frame 113 of the inner case 110.

The partition member 115 may be formed in a cylindrical or truncated cone shape. The foaming space 159 may be divided into a first region 116*a* (see FIG. 11) inside the partition member 115 and a second region 159*a* (see FIG. 13) outside the partition member 115.

The first region 116*a* may be aligned with the coupling hole 158 and the entrance hole 113*a*.

The first region 116*a* may provide the moving path of the coupling member S1 to be inserted through the entrance hole 113*a*.

Also, the first region 116*a* may provide the moving path for separating the coupling member S1 coupled to the cabinet cover 190.

In addition, a coupling groove 198 for coupling the coupling member S1 may be defined in the cabinet cover 190. The coupling groove 198 may be vertically aligned with the coupling hole 158.

A screw thread coupled to the coupling member S1 may be formed on an inner circumferential surface of the coupling groove 198. For example, a male screw thread may be formed on an outer circumferential surface of the coupling member S1, and a female screw thread may be formed on an inner circumferential surface of the coupling groove 198.

Figure 9:
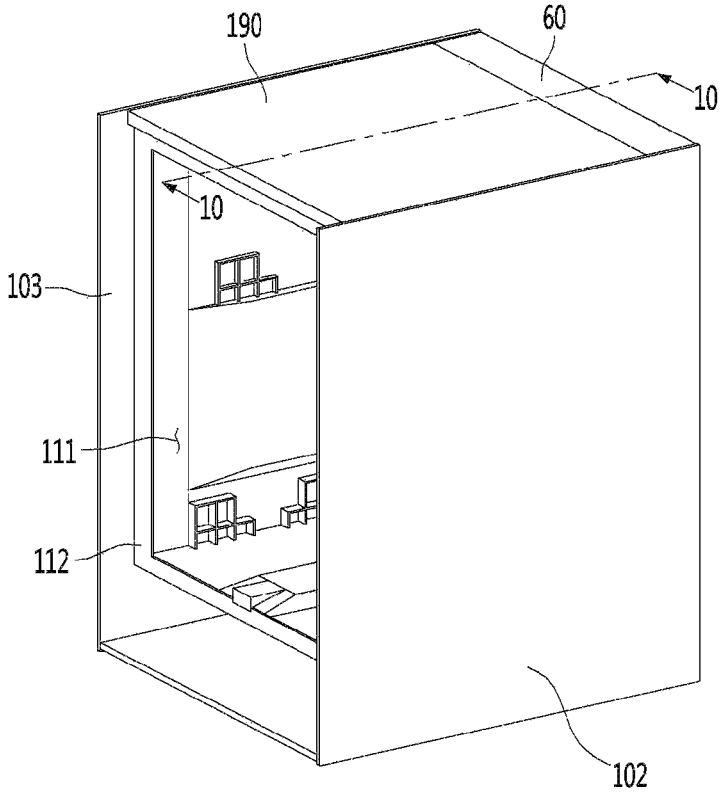
FIG. 9 is a perspective view of the cabinet.
Figure 10:
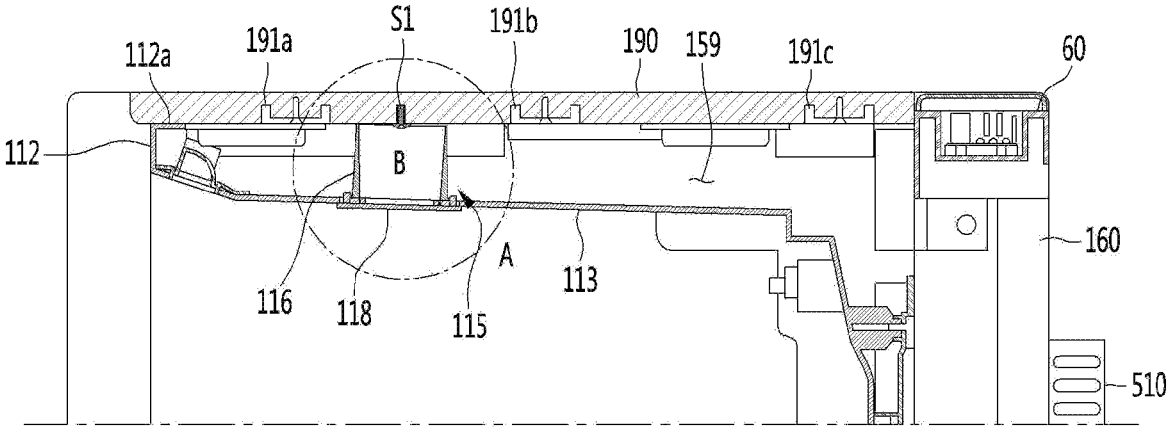
FIG. 10 is a cross-sectional view taken along line 10-10 of FIG. 9.

FIG. 9 is a perspective view of the cabinet, and FIG. 10 is a cross-sectional view taken along line 10-10 of FIG. 9.

Referring to FIGS. 9 to 10, the partition member 115 may include a partition body 116 having upper and lower openings.

The lower opening of the partition body 116 may be covered by a cover 118.

The partition body 116 may be disposed in the foaming space 159. The partition body 116 may be disposed between the inner case 110 and the middle plate 150.

In detail, the partition body 116 may be disposed between the top surface of the main frame 113 and the bottom surface of the upper plate 154.

The partition body 116 may be disposed below the cabinet cover 190. The partition body 116 may be disposed at a position adjacent to the door 20 at a lower sides of the cabinet cover 190.

In addition, the partition body 116 may be disposed between a plurality of adjacent reinforcing portions 191 at the lower side of the cabinet cover 190.

For example, the partition body 116 may be disposed between the first reinforcing portion 191*a* and the second reinforcing portion 191*b*.

As the partition body 116 is disposed relatively forward, the user or the service provider may facilitate the detachment of the cover 118 and the release of the coupling member S1 without putting their hands deeply. That is, the detachment of the cover 118 and the release of the coupling member S1 may be quickly performed.

Also, the partition body 116 may be disposed below a central portion of the cabinet cover 190 at the lower side of the cabinet cover 190.

For example, the partition body 116 may be disposed on a virtual line that bisects the cabinet cover 190 into left to right sides.

As another example, the partition body 116 may be disposed adjacent to a virtual line that bisects the cabinet cover 190 into left to right sides. The partition body 116 may be disposed at a lower side between the second and third cutoff grooves 193*b* and 193*c*.

The cabinet cover 190 may be stably fixed without moving forward or backward or being twisted in the left and right direction by the position of the partition body 116.

Figure 11:
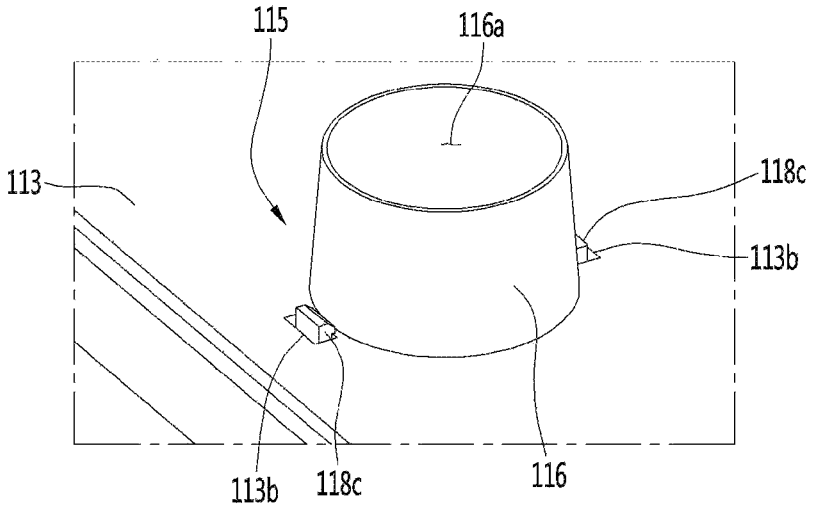
FIG. 11 is a perspective view of a partition member according to an embodiment of the present invention.
Figure 12:
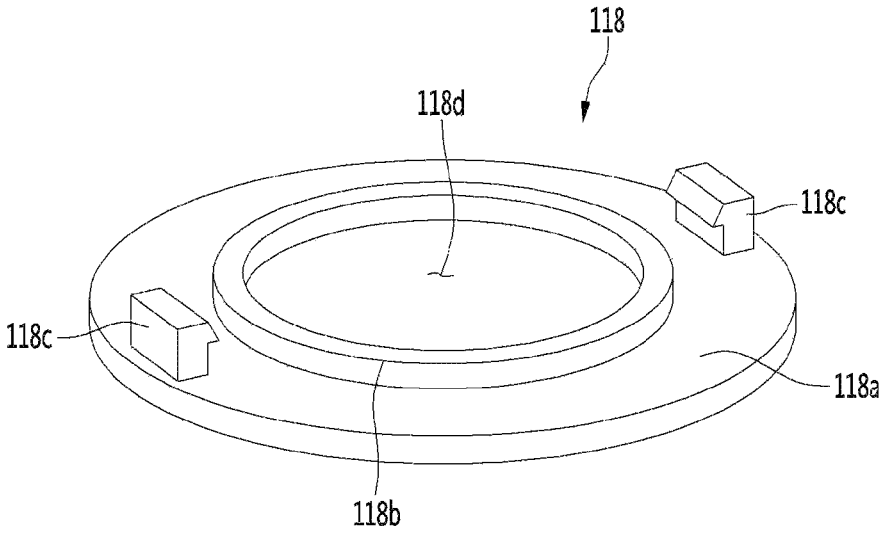
FIG. 12 is a perspective view of a cover according to an embodiment of the present invention.
Figure 13:
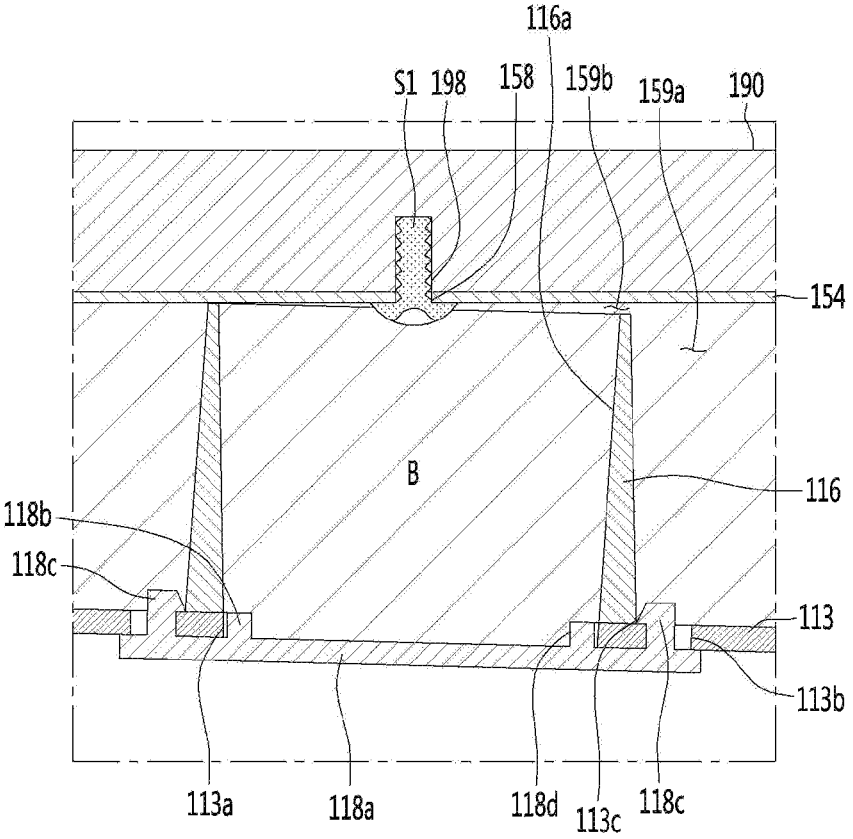
FIG. 13 is an enlarged view illustrating a portion A of FIG. 10.

FIG. 11 is a perspective view of the partition member according to an embodiment of the present invention, FIG. 12 is a perspective view of the cover according to an embodiment of the present invention, and FIG. 13 is an enlarged view illustrating a portion A of FIG. 10.

Referring to FIGS. 11 to 13, the partition body 116 may have a pillar shape having opened upper and lower sides. That is, a horizontal cross-section of the partition body 116 may have a circular shape. Thus, even if the foaming liquid is injected into the foaming space 159 through the injection hole, the foaming liquid may be smoothly spread without resistance along the outer circumferential surface of the partition body 116.

An inner space 116*a* that is a space in which the foaming liquid flows or a space in which an insulating material is disposed may be defined in the partition body 116. Here, the inner space 116*a* may be the first region 116*a* and be defined as a "moving path" of the coupling member S1.

The inner space 116*a* may communicate with the second region 159*a* and a cover space 118*d* (see FIG. 12) of the cover 118 to be described later by the upper opening and the lower opening of the partition body 116.

In addition, the insulating material may be disposed in the inner space 116*a* after the foaming liquid is injected.

An outer diameter of the partition body 116 may be formed to gradually increase downward from the upper side. On the other hand, an inner diameter of the partition body 116 may be formed to be constant or gradually decrease downward from the upper side.

That is, the inner space 116*a* may be constant or narrowed downward from the upper side due to the outer diameter and inner diameter of the partition body 116.

That is, the inner space 116*a* may be constant or narrowed downward from the upper side due to the outer diameter and inner diameter of the partition body 116, Therefore, even if an area of the upper opening communicating with the second region 159*a* among the upper opening of the partition body 116 is small, the foaming liquid introduced through the upper opening of the partition body 116 may be easily filled into the inner space 116*a*.

The partition body 116 may be disposed above the entrance hole 113*a*. In detail, an inner diameter of a lower end of the partition body 116 may be equal to or greater than a diameter of the entrance hole 113*a*.

The lower end of the partition body 116 may be installed on a top surface of the main frame 113 disposed outside the entrance hole 113*a*. The partition body 116 may be coupled to the top surface of the main frame 113 disposed at an edge of the entrance hole 113*a* in a state in which the lower opening of the partition body 116 is aligned with the entrance hole 113*a*.

For example, the lower end of the partition body 116 may adhere to the top surface of the main frame 113 by an adhesive means.

The top surface of the main frame 113 of the inner case 110 may be formed in an inclined shape. In detail, the top surface of the main frame 113 may be inclined in a direction closer to the upper plate 154 and the cabinet cover 190 forward.

Due to the shape of the top surface of the main frame 113, the upper end of the partition body 116 may be spaced a predetermined distance from the middle plate 150.

In detail, as the main frame 113 is formed to be inclined, the lower end of the partition body 116 may be disposed at the same inclination as the top surface of the main frame 113. On the other hand, the upper end of the partition body 116 may be disposed to move away from the bottom surface of the upper plate 154 from one side to the other.

For example, the upper end of the partition body 116 may be disposed to move away from the bottom surface of the upper plate 154 from the front side to the rear side.

A portion of the top surface of the partition body 116 may be spaced apart from the bottom surface of the upper plate 154.

Thus, a communication space 159*b* connecting the first region 116*a* (inner space) and the second region 159*a* may be defined in the top surface of the partition body 116, and the foaming liquid in the second region 159*a* may be introduced into the partition body 116 through the communication space 159*b*.

The cover 118 may be disposed in the storage space 111. The cover 118 may be mounted on the inner surface of the main frame 113 of the storage space 111.

The cover 118 may be disposed at a lower side of the partition body 116 and the entrance hole 113*a*. Thus, the cover 118 may be coupled to the inner case 110 in the internal region of the inner case 110 to cover the inner space 116*a* and the entrance hole 113*a*.

The cover 118 may include a plate 118*a* covering the lower opening of the partition body 116. The plate 118*a* may be formed in a disk shape.

A diameter of the plate 118*a* of the cover 118 may be greater than an outer diameter of the partition member 116 or a diameter of the entrance hole 113*a* to cover the entrance hole 113*a*.

The cover 118 may further include a sealing portion 118*b* protruding from the plate 118*a* toward the partition body 116.

The sealing portion 118*b* may be formed in a ring shape. The sealing portion 118*b* may be formed to have a set thickness and height. The sealing portion 118*b* may protrude upward from the top surface of the plate 118*a*.

Due to the shape of the sealing portion 118*b*, a cover space 118*d* may be defined inside the sealing portion 118*b*. The cover space 118*d* covers the first region 116*a* and the entrance hole 113*a* under the partition body 116.

An outer diameter of the sealing portion 118*b* may be formed to be the same as an inner diameter of the entrance hole 113*a*. The sealing portion 118*b* may be inserted into the entrance hole 113*a*.

In the state in which the sealing portion 118*b* is inserted into the entrance hole 113*a*, the outer surface of the sealing portion 118*b* may be supported by an inner circumferential surface of the entrance hole 113*a* to prevent the foaming liquid from leaking.

In addition, in the state in which the sealing portion 118*b* is inserted into the entrance hole 113*a*, the cover space 118*d* may be disposed in the entrance hole 113*a* and aligned with the inner space 116*a*. That is, when the foaming liquid is introduced, the foaming liquid may also be filled in the cover space 118*d*.

As another example, the sealing portion 118*b* may be made of an elastic material. Due to the material of the sealing portion 118*b*, it is possible to easily prevent leakage of the foaming liquid while the sealing portion 118*b* is inserted into the entrance hole 113*a*.

The cover 118 may include a hook portion 118*c* mounted on the main frame 113. The hook portion 118*c* may be formed to protrude from the plate 118*a* toward the partition body 116.

The hook portion 118*c* may be formed on the top surface of the plate 118*a*. The hook portion 118*c* may be formed outside the sealing portion 118*b*.

The hook portion 118*c* may be disposed to be spaced apart from an outer surface of the sealing portion 118*b*. The main frame 113 may be disposed in a space between the hook portion 118*c* and the sealing portion 118*b*.

A plurality of hook portions 118*c* may be provided. One of the plurality of hook portions 118*c* may be disposed at one side of the sealing portion 118*b*, and the other may be disposed at the other side of the sealing portion 118*b*. That is, the plurality of hook portions 118*c* may be disposed to face each other.

The hook portion 118*c* may protrude vertically from the top surface of the cover 118 to extend inward. A top surface of the hook portion 118*c* is inclined downward toward the inner side.

That is, a bottom surface of the portion extending to the inside of the hook portion 118*c* may extend horizontally so as to be seated on the top surface of the main frame 113.

In other words, the portion extending to the inside of the hook portion 118*c* may serve as a "hook" for mounting the cover 118 on the main frame 113.

A hook hole 113*b* defined outside the entrance hole 113*a* may be defined in the main frame 113. The hook hole 113*b* may be defined by passing through the main frame 113.

A plurality of hook holes 113*b* may be formed. The plurality of hook holes 113*b* are defined to correspond to positions of the hook portions 118*c*.

The hook hole 113*b* may be defined to be spaced apart from an outer surface of the cover 118. A support protrusion 113*c* may be disposed between the hook hole 113*b* and the outer surface of the cover 118.

The support protrusion 113*c* may be a portion of the main frame 113 and be understood as a surface on which the hook portion 118*c* is mounted.

The cover 118 may be elastically deformed. When the cover 118 is mounted, the hook portion 118*c* may be elastically deformed and inserted into the hook hole 113*b* and then restored to be seated on the support protrusion 113*c*.

That is, the hook portion 118*c* may be easily inserted into the hook hole 113*b*, and after being seated on the support protrusion 113*c*, the hook portion 118*c* may be prevented from being separated from the hook hole 113*b* unless a certain amount or more of force is applied.

A diameter of the cover 118 may be greater than a length from one hook hole 113*b* to the other hook hole 113*b* among the plurality of hook holes 113*b*. That is, even if a small amount of foaming liquid leaks through the hook hole 113*b*, the foaming liquid may be prevented from being introduced into the storage space 111 by the cover 118.

Hereinafter, a process of mounting and separating the cabinet cover 190 by the partition member 115 will be described in detail.

First, a process of mounting and fixing the cabinet cover 190 will be described.

The cabinet cover 190 is coupled to the middle plate 150. In detail, the cabinet cover 190 may be slidably mounted to the middle plate 150 by inserting the cover fixing portion 196 of the cabinet cover 190 into the cover fixing holes 156 and 916 of the middle plate 150.

In the state in which the cover fixing portion 196 of the cabinet cover 190 is disposed in the second holes 156*b* and 916*b* of the cover fixing holes 156 and 916, the coupling member S1 is coupled.

In detail, the coupling member S1 is inserted into the entrance hole 113*a* and the first region 116*a* (inner space) of the partition body 116 inside the storage space 111. The inserted coupling member S1 may pass through the coupling hole 158 of the middle plate 150 and be inserted into the coupling groove 198 of the cabinet cover 190.

Here, the coupling member S1 and an inner circumferential surface of the coupling groove 198 may be screw-coupled.

Thus, the coupling member S1 may be simultaneously coupled to the middle plate 150 and the cabinet cover 190.

In the state in which the coupling member S1 is coupled, the cover 118 is mounted to the main frame 113 from a lower side of the top surface of the main frame 113.

In detail, after aligning the sealing portion 118*b* and the hook portion 118*c* of the cover 118 with the entrance hole 113*a* and the hook hole 113*b*, the sealing portion 118*b* and the hook portion 118*c* are inserted into the entrance hole 113*a* and the hook hole 113*b*.

Force is applied to the cover 118 from an upper side so that an outer surface of the sealing portion 118*b* is in contact with an inner circumferential surface of the entrance hole 113*a*, and the hook portion 118*c* passes through the hook hole 113*b* so as to be seated on the support protrusion 113*c*.

When the cover 118 is in close contact with the main frame 113, the foaming space 159 including the second region 159*a* and the inner space 116*a* may be shielded.

The forward and backward movement of the cabinet cover 190 may be restricted by the partition member 115 and the coupling member S1, and the left and right movement may be restricted by the pair of side panels 102 and 103.

When the foaming liquid is injected into the foaming space 159 through the injection hole of the rear plate 152, the foaming liquid may be introduced into not only the second region 159*a* of the foaming space 159, but also the first region 116*a* of the partition body 116.

The foaming liquid introduced into the first region 116*a* may be solidified after a certain period of time and may serve as an insulating material.

Hereinafter, a process of releasing the fixing of the cabinet cover 190 and separating the cabinet cover 190 will be described.

The cover 118 mounted on the main frame 113 is separated. In detail, when certain force is applied downward by gripping the cover 118, the cover 118 may be separated.

The sealing portion 118*b* of the cover 118 may be separated from the entrance hole 113*a*, and the hook portion 118*c* may be elastically deformed and be discharged from the hook hole 113*b* by the applied constant force.

After the cover 118 is separated, the insulating material disposed in the inner space 116*a* of the partition body 116 is removed through the entrance hole 113*a*.

After the insulating material is removed, the coupling of the coupling member S1 is released from the cabinet cover 190. When the coupling member S1 is separated from the coupling groove 198 and the coupling hole 158, the cabinet cover 190 may be slid to be detached.

When the coupling member S1 is removed, the cabinet cover 190 may move horizontally. The cabinet cover 190 is disposed to be slid horizontally so that the cover fixing portion 196 of the cabinet cover 190 disposed in the second holes 156*b* and 916*b* of the cover fixing holes 156 and 916 is disposed in the first holes 156*a* and 916*a*.

When the cover fixing portion 196 is disposed in the first holes 156*a* and 916*a*, the cabinet cover 190 may be lifted upward to separate the cabinet cover 190 from the middle plate 150.

The separated cabinet cover 190 may be replaced with a new cabinet cover 190.

After replacing the cabinet cover 190, the removed insulating material or the new insulating material having the same size as the first region 116*a* of the partition member 115 may be accommodated in the first region 116*a* of the partition member 115, and then, the cover 118 may be coupled to the inner case 110.

According to an embodiment of the present invention, the cabinet cover 190 may be easily prevented from moving forward and backward by the partition member 115. As the forward and backward movement of the cabinet cover 190 is prevented, there is an advantage in that unintentional separation of the cabinet cover 190 by the user is prevented.

In addition, the coupling member S1 coupled to the cabinet cover 190 may be removed through the partition member 115, and thus, the cabinet cover 190 may be easily separated without the complicated disassembly process of the rear panel 160.

Since the separation process of the cabinet cover 190 is simple and takes a short time, the replacement service of the cabinet cover 190 may be performed quickly to improve service efficiency.

In addition, as the service efficiency is improved, user's service satisfaction may be improved.

In addition, since it is possible to eliminate the user's feeling of rejection and discomfort in the replacement process of the cabinet cover 190, there is an advantage in that the user's desire for the replacement of the cabinet cover 190 having a new design may be easily satisfied.

In another embodiment, the partition body 116 and the cover 118 may be integrally formed.

In this case, the partition member 115 in which the partition body 116 and the cover 118 are integrally formed may be mounted on the inner case 110 after coupling the coupling member S1 to shield the foaming space 159, and then, the coupling member S1 may be separated after releasing the mounting from the inner case 110.

As another embodiment, the partition body 116 may be integrally formed with the inner case 110. In detail, the partition body 116 and the top surface of the main frame 113 may be integrally formed. That is, the partition body 116 may be formed to protrude upward from the top surface of the main frame 113.

What is claimed is:

1. A refrigerator comprising:

an inner case configured to define a storage space;

a middle plate disposed on the inner case, and configured to define a foaming space between the middle plate and the inner case;

a cabinet cover disposed on the middle plate to define an outer appearance of a top surface, the cabinet cover to couple to the middle plate by a coupling member; and a partition member configured to provide a path for the coupling member to pass through the foaming space, wherein the partition member includes a partition body configured to separate the foaming space into a first region which is within the partition body to form the path and a second region which is external to the partition body, and at least a portion of a top surface of the partition body is spaced apart from the middle plate, and is configured to provide a communication space between the first region and the second region.

2. The refrigerator according to claim 1, wherein the middle plate includes a coupling hole to receive the coupling member that passes along the path of the partition member, wherein the inner case includes an entrance hole configured to allow the coupling member to pass to the path of the partition member, and the path of the partition member is aligned with the coupling hole and the entrance hole.

3. The refrigerator according to claim 1, wherein the partition member includes a cover configured to cover an entrance hole of the inner case.

4. The refrigerator according to claim 3, wherein the cover is to couple to an internal region of the inner case in order to cover the entrance hole.

5. The refrigerator according to claim 3, wherein the cover includes a sealing portion to be inserted into the entrance hole, and the sealing portion is configured to cover an entrance of the path of the partition member.

6. The refrigerator according to claim 1, wherein the cabinet cover includes a coupling groove to receive the coupling member that passes through the path of the partition member, the coupling groove is aligned with a coupling hole and the path of the partition member, and the coupling member is to couple to the middle plate and to the cabinet cover.

7. The refrigerator according to claim 1, wherein the cabinet cover includes a coupling groove to receive the coupling member, the coupling groove is aligned with the partition body and a coupling hole, and the coupling member is to couple to the middle plate and to the cabinet cover.

8. The refrigerator according to claim 7, wherein a cover is configured to cover an entrance hole of the inner case.

9. The refrigerator according to claim 1, wherein the cabinet cover includes a cover fixing portion that is selectively mounted on the middle plate, the cover fixing portion includes a first portion provided on a bottom surface of the cabinet cover and a second portion having a diameter greater than a diameter of the first portion, the middle plate includes a cover fixing hole to receive the cover fixing portion, the cover fixing hole including a first hole having a size to receive the second portion and a second hole extending from the first hole and having a size less than the size of the first hole.

10. The refrigerator according to claim 1, further comprising:

a door disposed in front of the inner case, and configured to open and close the storage space; and a rear panel configured to cover a rear surface of the middle plate and configured to define an outer appearance of the rear surface, wherein the partition member is disposed closer to the door than the rear panel.

11. A refrigerator comprising:

an inner case configured to define a storage space;

a middle plate disposed on the inner case, and configured to define a foaming space between the middle plate and the inner case;

a cabinet cover disposed on the middle plate to define an outer appearance of a top surface, the cabinet cover to couple to the middle plate by a coupling member;

a partition member configured to provide a path for the coupling member to pass through the foaming space, wherein the partition member includes a partition body configured to separate the foaming space into a first region which is within the partition body to form the path and a second region which is external to the partition body; and a cover configured to cover an entrance hole of the inner case, wherein the cover includes a hook portion configured to selectively mount to the inner case.

12. The refrigerator according to claim 11, wherein the cover includes:

a sealing portion to be inserted into the entrance hole, and the sealing portion is configured to cover an opening of the partition body, wherein the inner case includes a hook hole through which the hook portion is to pass to mount to the inner case, and after the hook portion passes through the hook hole, the hook portion is seated between the hook hole and an outer surface of the partition body on a top surface of the inner case.

13. The refrigerator according to claim 11, wherein the hook portion includes a plurality of hook portions, and each of the plurality of hook portions is spaced outward from an outer surface of the partition body.

14. The refrigerator according to claim 13, wherein the inner case includes a hook hole through which the hook portion is to pass to mount to the inner case, and after the hook portion passes through the hook hole, the hook portion is seated between the hook hole and an outer surface of the partition body on a top surface of the inner case.

* * * * *